US006634729B1

(12) United States Patent
Schuman et al.

(10) Patent No.: US 6,634,729 B1
(45) Date of Patent: Oct. 21, 2003

(54) APPARATUS FOR APPLYING INK INDICIA TO BOARDS

(75) Inventors: Thomas L. Schuman, Jefferson, GA (US); Joel Barker, Commerce, GA (US); Jody David Doak, Jefferson, GA (US)

(73) Assignee: J.M. Huber Corporation, Edison, NJ (US)

( * ) Notice: Subject to any disclaimer, the term of this patent is extended or adjusted under 35 U.S.C. 154(b) by 0 days.

(21) Appl. No.: 10/170,051

(22) Filed: Jun. 12, 2002

(51) Int. Cl.[7] ..... B41J 2/00
(52) U.S. Cl. ..... 347/2
(58) Field of Search ..... 347/2, 3, 4, 5, 347/16; 198/618

(56) References Cited

U.S. PATENT DOCUMENTS

| | | | |
|---|---|---|---|
| 2,328,943 | A | 9/1943 | Backhouse |
| 3,748,578 | A | 7/1973 | Ward |
| 3,848,646 | A | 11/1974 | Miles |
| 3,877,367 | A | 4/1975 | Norwood |
| 3,888,478 | A | 6/1975 | Alderman, Jr. et al. |
| 4,163,491 | A | 8/1979 | Rock et al. |
| 4,324,519 | A | 4/1982 | Moore |
| 4,377,783 | A | 3/1983 | Wagner |
| 4,814,795 | A | 3/1989 | Kuester et al. |
| 4,995,858 | A | 2/1991 | Stab |
| 5,123,640 | A | 6/1992 | Rebeaud |
| 5,233,400 | A | 8/1993 | Cahill |
| 5,829,741 | A | 11/1998 | Dopke et al. |
| 6,234,602 | B1 | 5/2001 | Soto et al. |
| RE37,472 | E | 12/2001 | Baker |
| 2002/0002932 | A1 | 1/2002 | Winterowd |

OTHER PUBLICATIONS

Product Brochure: Globe Machine, Globe Finishing Lines for OSB, Feb. 19, 2002.
Product Brochure: Matthews International Corporation, Matthews Helps Boise Stay Strong & Level With Impulse Marking Systems, Feb. 18, 2002.
Product Brochure: Matthews International Corporation, Ink–Jet Printing in Detail, Feb. 18, 2002.
Product Brochure: Matthews International Corporation, Durable and Reliable Drop–on–Demand Ink–Jet Technology, Feb. 18, 2002.

*Primary Examiner*—Raquel Gordon
(74) *Attorney, Agent, or Firm*—Carlos Nieves; David M. Goodrich

(57) ABSTRACT

In an apparatus for applying ink patterns on oriented strand boards, the boards are serially moved closely adjacent to and past ink jets, and ink is deposited on the boards. To deposit the ink accurately on the boards they are advanced by pinch and drive rollers which also ensure that the boards are flat as they move past the jets. Detectors are used to detect boards which cannot be flattened or are irregular in shape and in such a case the ink jets are moved to avoid impact by an irregular board. During printing, the panels and the ink jets are about 0.0625 inches to about 0.125 inches apart, and the panels are moved at a rate of about 150 ft/minute to 600 ft/minute.

12 Claims, 3 Drawing Sheets

APPARATUS FOR APPLYING INK INDICIA TO BOARDS

BACKGROUND OF THE INVENTION

Wood boards or sheets, typically made from wood composite products like plywood or oriented strand board, are common construction materials in commercial, industrial and residential buildings. During construction, these boards are placed over and fastened to an underlying supporting frame to form the wall, roof or floor of the building. In order to improve the efficiency of fastening the boards to this frame, a pattern may be printed on the board or panel in order to rapidly attach the board to the frame structure.

Typically, ink is applied onto a board to form these patterns during the last stage of manufacture, shortly before the boards are packaged and readied for shipment. Most manufacturers perform this marking step at approximately the same speed as the speed at which the boards are inspected for defects so as to not interfere or impede board production. Unfortunately this high marking speed reduces the accuracy and intricacy of patterns that can be formed during marking, which may result in marking patterns that are simple or crude. While such markings might provide a minimally useful set of reference points, they do not maximize product versatility nor impart any special distinctiveness to the product.

One way to improve the marking process is to reduce the separation between the surface of the board and printheads of the printing system (commonly referred to as the "throw distance") that apply ink to the board (typically the printing system includes several print heads). When the throw distance is small, more accurate and intricate patterns may be formed on the board. However, such small separations between the surface of the board and the print heads also increases the possibility that during manufacture a board that is oversized, warped, misaligned or has a non-uniform thickness may accidentally contact the print heads and severely damage or destroy them. Because of this, a consistent gap must be maintained between the boards and the print heads. Furthermore, these variations of the board thickness and height can compromise the accuracy with which the ink is applied to desired locations on the boards thus, further deteriorating the quality of the patterns formed on the board surface.

Accordingly, there is a need for an apparatus to apply ink to the printing surface, wherein small separations between the boards and the ink application system can be used to enable intricate and accurate printing of complex patterns and designs at high production speeds. Furthermore, it is also desirable that the apparatus should have means for applying a normal force at several locations on the print surface to the boards to keep the printing surface of the boards in a flat, planar shape, the planar shape increases the accuracy of the locations that the inks are applied to the printing surface and thereby increases the quality of the patterns, marks, and ornamental designs formed on the printing surface of the boards.

BRIEF SUMMARY OF THE INVENTION

What has been invented is an apparatus for applying ink patterns on boards, including: means for serially moving the boards in a selected direction and through a predetermined space; means for applying ink, said means for applying ink being movable from a first position adjacent the predetermined space to a second position remote from the predetermined space; and means for detecting boards moving in the selected direction and having a part thereof outside the predetermined space. The apparatus also includes: means responsive to the detecting means, for moving the means for applying ink from the first position to the second position when a board traveling in the selected direction is outside the predetermined space, whereby contact between moving boards and said means for applying ink is avoided; and means for controlling the means for applying ink to apply the ink patterns on the boards traveling within the predetermined space.

A feature of the invention is that the apparatus is capable of applying ink patterns on boards moving at rates of about 150 ft/min to 600 ft/min.

Another feature of the invention resides in that ink can be applied to boards at desired locations, as they move, with an accuracy of ∀0.125 inches.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
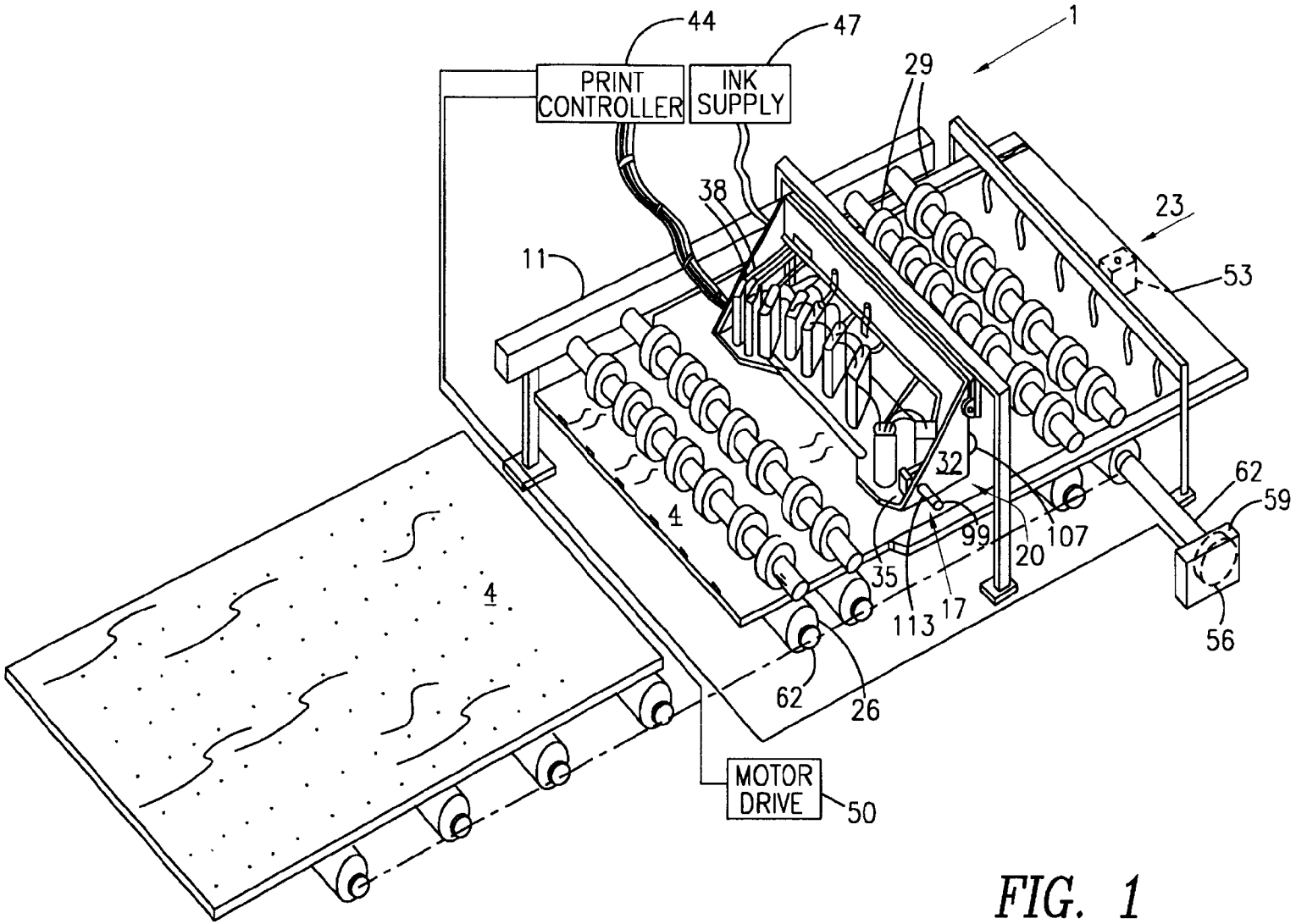
FIG. 1 is a perspective view showing the arrangement of an apparatus for applying ink to boards, according to a preferred embodiment of the present invention.

All documents cited herein are incorporated by reference.

As used herein, "board" is intended to include boards or sheets, typically made from wood composite products like plywood or oriented strand board, as well as composite panels that are made from a blend of wood, polymer and mineral materials. Mineral or polymeric fiber are also suitable for use.

By "wood composite material" it is meant a composite material that comprises wood and one or more other additives, such as adhesives or waxes. The wood is typically in the form of veneers, flakes, strands, wafers, particles, and chips. Non-limiting examples of wood composite materials include oriented strand board ("OSB"), waferboard, particle board, chipboard, medium-density fiberboard, plywood, and boards that are a composite of strands and ply veneers. As used herein, "flakes", "strands", "chips", "particles", and "wafers" are considered equivalent to one another and are used interchangeably. A non-exclusive description of wood composite materials may be found in the Supplement Volume to the Kirk-Rothmer Encyclopedia of Chemical Technology, pp 765–810, $6^{th}$ Edition.

The present invention is directed to an apparatus for applying ink to boards to form simple marks and patterns as well as more complicated ornamental designs. Typically these boards are made from a wood composite material, especially oriented strand board ("OSB"). Physically, these boards are typically 4 ft by 8 ft and 0.25 inches to 1.5 inches thick, and thus, weigh in the range of 20 lbs to 200 lbs. In this apparatus, boards are moved through a predetermined space, and a means for applying ink onto a print surface of the boards is, in its first position, located adjacent the predetermined space. The apparatus also contains a means for detecting boards having a part outside the predetermined space (because, e.g., the board is warped or has a non-uniform thickness), as well as means responsive to the detecting means for moving the means for applying ink from the first position to the a second positions when a board traveling in the selected direction is outside the predetermined space, thereby avoiding contact between moving boards and the applying means and thereby preventing damage to the applying means and the electronics contained therein. As a second form of protection for the applying means, it is preferable to include a plurality of pinch rollers for biasing boards moving through the predetermined space against a plurality of drive rollers. The drive rollers are disposed to contact the boards at points in a common plane and rotate about parallel axis to serially move the boards.

Through the combined use of these protective mechanisms, as well as other means discussed below, the separation between the boards and the means for applying ink (the throw distance) can be greatly reduced thereby improving the quality of the marks and designs formed by the ink on the board without incurring a significant risk of damaging the applying means. Moreover, because of this small separation between the applying means and the boards, the boards can be marked at much higher speeds.

Furthermore the pinch rollers bias the boards against a plurality of drive rollers, desirably keeping the printing surface of the boards in a flat, planar shape as the boards pass through the predetermined space and under the applying means. By maintaining the printing surface in this shape, the accuracy and intricacy of the patterns and designs printed by the applying means on the board can be improved.

Referring now to FIG. 1, a preferred embodiment of an apparatus 1 for printing marks on boards is shown. The apparatus includes a frame 11 (partially shown) for supporting the boards 4 as the boards 4 move serially through the apparatus 1. A preferable frame 11 is a Globe™ 16Q hold-down device made by the Globe Machine Manufacturing, Tacoma, Wash. This frame 11 conveys the boards 4 from the final stages of the OSB manufacturing line (not shown) in the selected direction 23 to the predetermined space 17 where ink is applied onto the print surface 20 of the boards 4 (the print surface 20 is that area of the boards on which the ink is injected or applied to print marks or designs). The predetermined space 17 is a rectangular space having a length and width commensurate with the length and width of the means for applying in to the boards, and the predetermined space 17 has a thickness about equal to the thickness of boards to be process plus the desired throw distance.

The apparatus 1 further includes means for serially moving the boards in the selected direction 23. The means for moving the boards in a forward direction are a motor 50 responsive to a controller 44 and mechanical apparatus (not shown) connecting the motor to the plurality of drive rollers 26. These drive rollers 26 are located on four shafts 62 below the board level, and preferably each of these drive rollers 26 is made from steel and coated with rubber or some other material that reduces slippage and establishes a good grip on the boards 4 to move them forward.

The means for serially moving the boards also preferably comprises a series of pinch rollers for biasing the boards moving in the selected direction 23 and through the predetermined space 17 against the drive rollers. As shown in the figures, the pinch rollers 29 are on shafts located above the level of the boards 4, and vertically above each of the drive rollers 26 is a corresponding pinch roller 29. In operation, each of the pinch rollers 29 engage the boards 4 and supply a biasing force substantially normal to the print surface of the board 4 to keep the print surface flat and planar so as to improve the accuracy with which ink is applied to the print surface. Preferably a uniform bias force distribution is applied to the panel that does not interfere with the desired print pattern. The pinch rollers 29 are set to a predetermined gap from the drive rollers 26, and a predetermined compression is set using a spring or pneumatic actuator to maintain the biasing force on the board surface. This configuration maximizes the planar configuration to ensure a uniform print gap, while minimizing slippage of the boards as they pass over the drive rollers 26 to enhance speed control. It is worth noting that the means for supporting the pinch rollers is not illustrated in FIG. 1 in order to allow the exact positioning and spacing of the pinch rollers under the boards to be shown. A person of ordinary skill in the art would be capable of preparing a structure that would support the pinch rollers while allowing them to freely rotate, the rotation being powered by the motor drive 50. The structure supporting the pinch rollers may or may not be part of the frame 11 element.

With the drive rollers 26 moving the boards 4 in the selected direction 23, and the pinch rollers 29 providing a normal forces to the printing surface 20 to keep it flat, the boards 4 move serially through the apparatus 1 and through the predetermined space 17. When the applying means are in the first position, the applying means are adjacent the predetermined space 17 as shown in FIG. 1 (in the figure the applying means are represented by mounting plate 35 ink jet printheads, discussed in greater detail below), and as boards 4 enter into the predetermined space 17, marks are placed upon the boards 4 by the applying means. The applying means can be moved from the first position to a second position, which is remote from the predetermined space, in order to avoid damage to the applying means in case a part of a board moving in the select direction falls outside of the predetermined space (perhaps because the board is warped or of a non-uniform thickness).

In order to make use of the mobility of the applying means, the present apparatus also includes means for detecting when part of a board falls outside of the predetermined space, as well as means responsive to the detecting means for moving the applying means from the first position to the second position. The detecting means monitors the boards 4 moving in the selected direction, and if a part of the board is outside the predetermined space (and is thus too close to the means for applying ink) then the means responsive to the detecting means moves the applying means form the first position to the second position, and thus out of harm's way. Suitable detection equipment such as trip switches, lasers, sonar systems, or any other form of analytical detection equipment. If these electronic devices detect that a part of the board is outside the predetermined space 17, they generate a signal, which is then transmitted to the responsive means to initiate the movement of the applying means from the first position to the second position to prevent damage to the applying means. Also suitable is a preferred device that functions not by electronic, sonic or light sensing, but by mechanical action, such as a spring, discussed in greater detail herein below.

The applying means includes a carriage 32 pivotally coupled to the frame 11. The carriage has a mounting plate 35, and a number of ink jet printheads are coupled to the mounting plate 35. Preferably the ink jet printheads 38 are positioned so as to be oriented in a uniform print direction for easy message creation and maximized printing accuracy. Mounting in modular plates allows easy exchange among new and spare parts and reduces manufacturing cost. Each ink jet printer is best mounted recessed from the bottom of the mounting plate 35 for protection from chips, flakes, or splinters. However, they may be mounted flush with the bottom of the mounting plate 35 in order to reduce the throw distance. To improve the resolution of the marks and ornamental designs imprinted on the board, it is preferred that the applying means, such as the ink jets, should be positioned about 0.0625 to about 0.125 inches above the print surface on the board 4.

Figure 2:
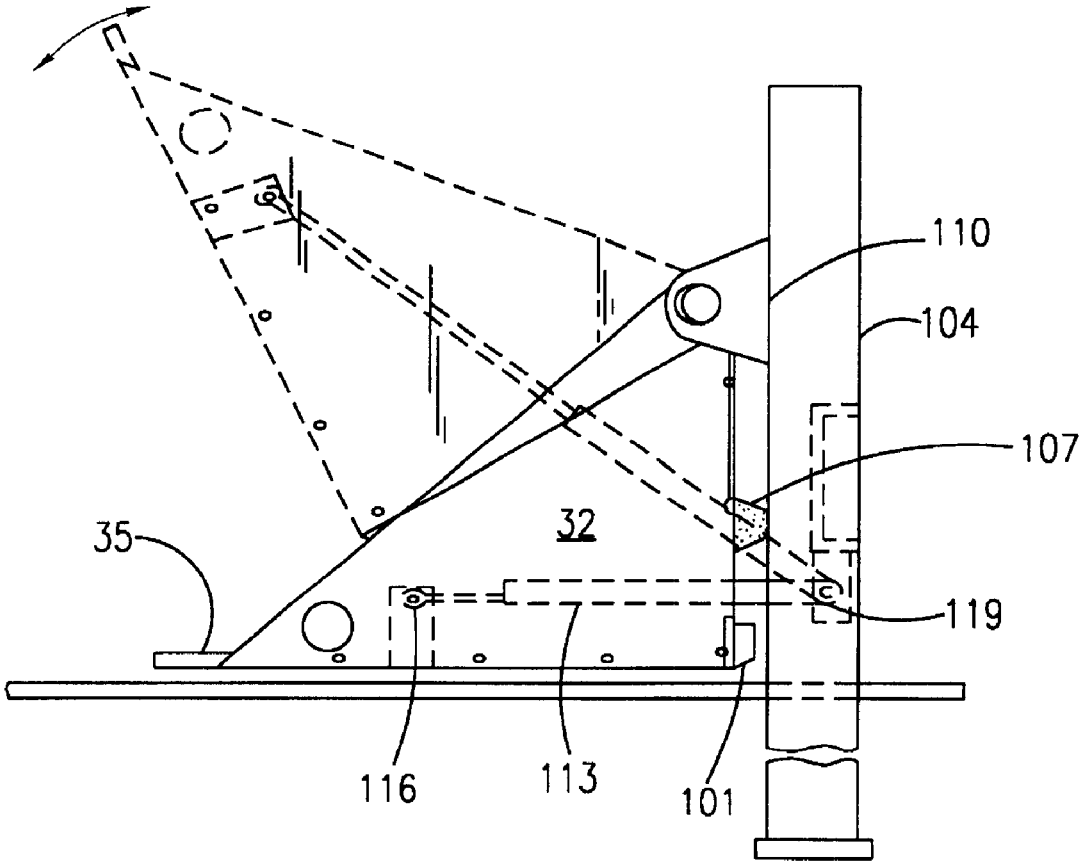
FIG. 2 is a partial elevated side view of the apparatus, showing a movable carriage, prepared according to the present invention.

In some situations, a part of the board will be positioned slightly outside the predetermined space, in which case rather than causing the movement of the applying means, the part of the board outside the predetermined space may instead be guided by a deflector 101 into the predetermined space 17, with minimal interruption of the marking operation. The deflector 101 is best seen in FIG. 2. It has a deflector 101 This deflecting means is illustrated in FIG. 2 as a beveled guide edge 101 located on the carriage 32. This provides yet another way of preventing the boards from damaging the applying means, and this protective mechanism has the further advantage of not interrupting the printing operation. Indeed, in this aspect of the invention, the sheer mass of the mounting plate provides a significant amount of impact absorption to provide further protection to the ink applying means, such as the inkjet printheads.

FIGS. 1 and 2 also show means for detecting when a part of the board lies outside the predetermined space, as well as means responsive to the detecting means for moving the means for applying ink from the first position to the second position when a board traveling in the selected direction is outside the predetermined space. Specifically, the carriage 32 is pivotably attached to the vertical support 104 at a bracket 110, the bracket 110 being located adjacent to the free end of the vertical support 104. One end 119 of a coil spring 113 is attached to the vertical support 104 below the bracket 110, while the opposite end 116 of the coil spring 113 is attached adjacent to the carriage near the unattached end of the mounting plate. When the apparatus is operating in normal printing mode, i.e., the carriage is in the first position as shown in solid lines) and is applying ink onto the boards 4, the mounting plate 35 is positioned over the predetermined space 17, and is substantially parallel to the print surface of the board 4. When the carriage 32 is in this first position, the spring 113 is under compression and stores potential energy. Additionally, an abutting piece 107 may be present to limit the counterclockwise movement of the mounting plate 35 through a fixed range.

Operatively, as the board moves in the selected direction 23, and if a part of the board is outside the predetermined space so that the board contacts the carriage 32 with a threshold force (more fully described below) then a portion of the kinetic energy of the board is transferred to the spring 113. The spring 113 then extends and, converting the stored potential energy into kinetic energy, causes the carriage 32 to pivot clockwise away from the predetermined space 17 into the second position so that the boards 4 to pass harmlessly through the predetermined space 17 without damaging the ink jet printheads 38 (in FIG. 2, the second position of the mounting plate 35 is shown in broken lines).

Thus, the detecting means includes the deflector 101 and the mechanical action of the spring itself. If the force with which a board contacts the carriage 32 is sufficient then it and the force exerted by the coil spring 113 in compression, then the spring 113 is taken out of compression and swings the carriage 32 clockwise around the pivot point 110, until it reaches the second position, which is an equilibrium point where the spring is extended and in tension and the force of the spring pushing outward balances the force of gravity pulling the carriage 32. Thus, the strength of the spring 113 (the value of the spring constant) itself determines the amount of force necessary to initiate the movement of the mounting plate 35, and thus, the spring functions as the detecting means for determining when a part of the board is sufficiently outside the predetermined space 17 as to require rotation of the carriage 32. It is worth noting that the spring 113 is also a part of the means responsive to the detecting means for moving the applying means (the applying means including the carriage 32) from the first position to the second position. Besides a spring, gas shocks may also be used to determine the force need to rotate the carriage. By using gas shocks, the amount of pre-loading applied to the gas shock can be precisely controlled, so that the sensitivity of the carriage to potential impacts can be precisely specified. Additionally, the apparatus also preferably includes a handle 99 so that the position of the carriage can be manually adjusted.

The apparatus includes vertical adjusting means to adjust the distance between the applying means and the print surface of the boards (the throw distance). This distance can be made smaller so as to optimize print quality, or larger in order to accommodate thick boards or boards having a significant amount of variation in thickness. Although not shown in the embodiments, the vertical adjustment is provided by linear actuators driven on a common shaft to assure parallel height adjustments. Which allows easy incorporation of a height gauge. Preferably the linear actuators are driven either electrically or pneumatically.

As discussed above, the applying means preferably makes use of ink jet technology. Preferably, the ink jets are present as multiple ink heads consisting of a multiplicity of valves, each valve equipped to apply ink onto the print surface 20 of the boards 4. These ink marks are deposited on the board in a pattern such as simple geometrical objects like triangles, squares or circles, or in more complex patterns such as ornamental designs, graphics, or distinctive lettering indicating product trade name or manufacture. The number of valves in the printhead determines whether the printhead is used to form ink marks and patterns or larger, more complex ornamental designs. FIG. 1 shows a preferred embodiment in which a series of ink jet printheads 38 are supported on the mounting plate 35.

The present apparatus also includes a means for controlling the means for applying ink to apply the ink patterns on the boards that travel within the predetermined space. Although not required to be automated, it is preferred that control means is coordinated by a computer controller 44. The printer controller 44 is preferably programmed and controlled through user inputs provided through a key pad (not shown), touch screen (not shown) or other input device located on the exterior of the print controller housing. Another suitable input devices is a PC serially connected to the printer controller. An advanced computer control interface unit, having a computer keypad, may be used to control and program the printing of particular patterns on the board 4.

Suitable ink jet heads and print controllers are custom-made or modified from readily available commercial sources. For example, the Matthews Corporation of Pittsburgh, Pa. produces ink jet systems under its Jet-a-Mark® brand. These ink jet systems use drop-on-demand ink jet technology to form printed characters and graphics on the board. The ink-jet heads can contain either 16 valves (for forming simple patterns on a board) or 32 valves (for forming more complex graphical patterns or distinctive lettering). A print resolution of 6.25 to 32 dpi is capable with this system. A suitable computer controller is the Jet-a-Mark R4 from the Matthews Corporation of Pittsburgh, Pa.

The means for controlling the applying means may be done manually. Thus, an operator may manually control the movement of boards 4 into the predetermined space 17 and then manually initiate the application of ink onto the print surface 20 of the board 4 to form marks, patterns and designs. However, in order to increase the speed of the marking process, as well as the precision with which the marks are placed on the printing surface, and to minimize the amount of operator intervention, it is preferred that the control means be automated.

In an automated and preferred process, the boards 4 are moved in the selected direction by the drive rollers 26 into the predetermined space. The drive rollers 26 may be powered and regulated by a synchronous drive ("timing") belt (not shown), which synchronizes the speed of each of the drive rollers 26 to maintain a consistent speed at which the boards are brought into the predetermined space. Typically the synchronous drive belt is a fiber-reinforced polymeric belt. The synchronous drive belt can improve the printing precision, and has the advantage over a gear/chain system, in that the gear/chain system can stretch and wear over time and fail suddenly and catastrophically.

A Variable Frequency Drive ("VFD") can be used to alter the speed of the boards as they travel in the selected direction and pass through the predetermined space 17. The "VFD" increases the speed of the panels as they are conveyed into the predetermined space 17 so that they travel faster than the boards that have yet to enter the predetermined space 17. This ensures that a gap is formed between adjacent panels as they enter the predetermined space 17 end-to-end, which allows the photo eye (discussed below) to differentiate between two adjacent panels and thereby initiate printing onto the boards at the correct time. Preferably, a minimum gap of about one inch is formed between adjacent panels.

The present apparatus includes means for monitoring the movement of the boards in the selected direction as they enter the predetermined space 17. This monitoring means informs the print controller 44 of the exact location of the board and that the board is about the enter the predetermined space, so as to initiate the printing process. In controlling the applying means, the print controller 44 takes into account the location of the board, and the speed at which the board is moving in the selected direction. Many different suitable technologies may function as the means for monitoring the movement of the boards, but the use of a photo eye is preferred.

FIG. 1 shows a photo eye 53 placed below the level of the boards 4 for detecting the movement of the boards in the selected direction into the predetermined space 17. The photo eye 53 is preferably a split-beam photocell utilizing a modulated, narrow beam. When the board crosses a beam emitted by the photo eye 53 (or other equivalent monitoring means), the photo eye 53 transmits a signal to the print controller 44 relaying the exact location of the board, and initiates the printing process. A suitable photocell is a modified Banner Engineering Mini-beam SM312DSC, available from the Matthews Corporation with a custom fiber-optic extension (B6578-503-00). A custom-designed bracket for the photo eye allows positioning or calibration of print initiation to the leading edge of the panel.

As the photo eye triggers the print controller to commence the printing process, the print controller also monitors the speed at which the boards 4 are moving in the selected direction so that the applying means can be properly controlled to form the desired combinations of patterns and graphics at the separate locations on the print surface 20 of the boards. Many different means may be used to measure the speed of the board, but a preferred means is the use of an encoder. In the embodiment shown in FIG. 1, one of the shafts 62 of a drive roller is extended beyond the hold-down apparatus and a the rotary encoder 56 mounted directly to the portion of the shaft 62 of the drive roller 26 that extends beyond the hold down apparatus. The components for measuring the rotational speed of the rotary encoder (an optical reader, sensor or similar device, as discussed in detail below), are housed in the box 59, but not specifically shown. By mounting the encoder 56 on a shaft 62 extended beyond the hold-down apparatus, sawdust buildup on the encoder is prevented, and the distorting effects of thermal expansion reduced. The information gathered by the encoder 56 is transmitted to the controller 44.

Another alternative for installing of the encoder wheel makes use of a set of gears connected by a belt. In this installation (which is not illustrated in the figures), a first gear is mounted on the driver roller 26, and is mechanically connected by a belt to a second gear, which is mounted around an external shaft. The gears are given a proper ratio with respect to each other, so that the rotational speed of the external shaft has nearly the same precise rotational speed as the driver roller to which the first gear is mounted. The encoder is then attached to this external shaft. Because the encoder is located at some distance from the finishing line, both sawdust buildup and the distorting effects of changes in the drive-roll diameter are minimized.

The rotary encoder wheel 56 has indicia on its side and an optical encoder reader or sensor reads the indicia on the rotary encoder to provide a positional or board velocity signal to the print controller. As the rotary encoder is engaged by the drive rollers 26 or as it rotates around the drive rollers 26, a positional or velocity signal is supplied to the controller 40 which coordinates the firing signals sent to the inkjet valves to direct the ink droplets to print an image according to the instructions provided by the operator through the print controller.

Figure 3:
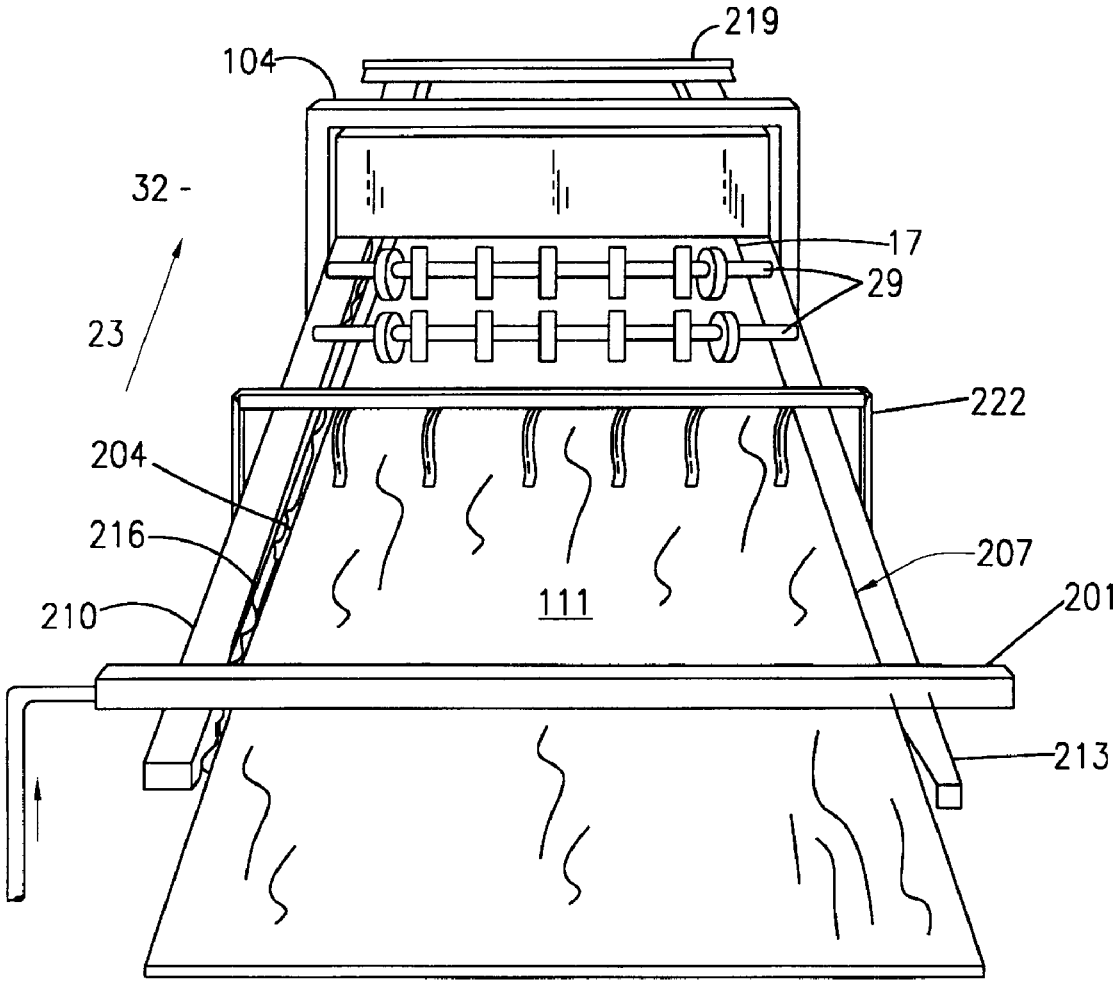
FIG. 3 is a rear perspective view of a modified apparatus, according to the present invention.

The apparatus may also include other optional elements, such as means for treating the surface of the boards. These treating means include devices for removing dirt or other particles from the surface of the boards, as well as other devices such as anti-static equipment. In FIG. 3 the means for treating the surface of the boards includes an air knife 201 or brush attached to the frame to remove dust from the print surface of the boards 4. An air knife applies a uniform flow of air across the print surface of the board to remove particles or debris from the print surface. Suitable air knives include the "Standard Air Knife™", and the "Super Air Knife™" from the Exair Corporation, Cincinnati, Ohio. Additionally, an anti-static device (such as shown as 222 in FIGS. 1 and 3) may be attached to the support means to dissipate static electricity that builds up on the print surface after sanding OSB. Such static electricity can scatter ink droplets during printing, and this static electricity can also pose an explosive hazard at particular solvent concentrations and so it is highly desirable to remove this static electricity.

"Tinsel bars" are suitable for this purpose. These bars consist of dangling copper "tinsel" secured to a rigid anodized aluminum holder connected to a ground. These devices are available from TAKK Industries, Inc. of Cincinnati, Ohio.

The present apparatus also preferably includes a lateral alignment means for aligning the boards with lateral edges of the frame. This lateral alignment means is used so that the board is properly aligned along the lateral edges of the frame (shown as items 204 and 207 in FIG. 3); this ensures that the board is properly aligned so that the ink marks are placed on the printing surface in the correct locations in order to from simple geometrical shapes or more complex patterns. In FIG. 3, the lateral alignment means are the combination of a left fence 210 and a right fence 213 that extend substantially parallel to each other. Extending from the left fence 210 are several leaf springs 216 which press against the lateral edge 204 of the board 14 to force the board against the right fence 213 to establish an accurate right edge 207 reference with the ink jet heads as the board 14 moves through the predetermined space 17.

If desired, another air knife 219 can be positioned on the far side of the predetermined space, beyond the ink applying means to accelerate the drying of ink marks on the surface of the boards subsequent to their passing through the predetermined space 17. This additional air knife may be selected from among the types of air knives described above.

Any suitable ink for use on boards is suitable for use in the present invention. Preferably, the marking ink is a colorant (either a pigment or dye) suspended or dissolved in a solvent or continuous phase. The preferred continuous or solvent phase is an alkyl ester, such as ethyl acetate or ethyl butyl acetate. The colorant is preferably a mineral material and the colorant preferably has a sufficiently high molecular weight so that it does not easily diffuse or migrate through plasticized floor coverings such as vinyl linoleum. The colorant may be used to form colored patterns as discussed in patent application Ser. No. 10/012,918, filed Oct. 30, 2001, entitled "Boards Comprising an Array of Marks to Facilitate Attachment", which is hereby incorporated by reference. Preferably, the ink should be highly resistant to fading caused by ultraviolet light, and quick drying, with a drying time of between about 1 to about 10 seconds. In addition to the colorant, the ink may also contain several other ingredients such as viscosity enhancing agents or thickeners, surfactants, polymeric binding agents, opacifyers, preservatives, optical brighteners, plasticizers, dispersing aids, coalescing agents, and defoaming agents.

A preferred ink is a dry black "non-settling" ink that is a suspension of pigment particles in a solvent phase of ethyl acetate. The viscosity of this black, non-settling ink is 2.3 to 3.5 cps at 80° F. The ink has a drying time of about 5 to about 10 seconds.

As mentioned above, the ink may be applied to the print surfaces of boards to form marks, barcodes, date, crew designations, installation instructions or other such instructions, alphanumeric characters, and ornamental designs. The marks are preferably grouped as arrays to identify locations where fasteners (not shown) can be used to attach the boards to a frame structure to form walls, roofs or floors. The marks on the board may be selected from several different forms including circles, dots, squares, diamonds and other suitable forms. The patterns which can be formed on the boards are described in greater detail in patent application Ser. No. 10/012,918, entitled "Boards Comprising an Array of Marks to Facilitate Attachment", incorporated above.

Although the boards 4 can be made of any commonly used material, it is preferred that the board be made from a wood or wood composite material, and a preferred wood composite material is OSB. Methods for making OSB, as well as suitable OSB compositions are well-known to those of ordinary skill in the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for applying ink patterns on boards, comprising:

means for serially moving the boards in a selected direction and through a predetermined space;

means for applying ink, said means for applying ink being movable from a first position adjacent the predetermined station to a second position remote from the predetermined space;

means for detecting boards moving in the selected direction and having a part thereof outside the predetermined space;

means responsive to the detecting means for moving the means for applying from the first position into to the second position when a board traveling in the selected direction is outside the predetermined space, whereby contact between moving boards and said means for applying ink is avoided; and means for controlling the means for applying ink to apply the ink pattern on the boards traveling within the predetermined space.

2. The apparatus as defined in claim 1 wherein the means for serially moving the boards includes: a plurality of drive rollers; a plurality of pinch rollers for biasing boards moving through the predetermined space against the drive rollers; and means coupled to the drive rollers for moving the boards in said selected direction at a rate of about 150 ft/min to 600 ft/min.

3. The apparatus as defined in claim 2 wherein the means for applying ink includes: a vertical support; a carriage pivotally coupled to the vertical support, the carriage having a mounting plate; a number of ink jets coupled to the mounting plate, the carriage being movable to said first position, in which the ink jets are adjacent to said predetermined space, and as boards move through the space the ink jets are about 0.0625 to about 0.125 inches from the board surfaces to which the ink patterns are applied.

4. The apparatus as defined in claim 3, wherein said means for detecting boards is selected from the group consisting of: trip switches, lasers, sonar systems, and a spring.

5. The apparatus as defined in claim 3, wherein said means for moving the means for applying ink includes at least one spring coupled to the carriage at one end and the vertical support at the other and wherein the at least one spring is under compression when the carriage is in the first position.

6. The apparatus as defined in claim 5, wherein the carriage pivots from the first position to the second position.

7. The apparatus as defined in claim 3, further comprising a lateral alignment means for aligning the boards with lateral edges of a frame.

8. The apparatus as defined in claim 3, wherein the ink jets are positioned so as to be oriented in a uniform print direction.

9. The apparatus as defined in claim 8, wherein the lateral alignment means includes a pair of fences extending substantially parallel to each other.

10. The apparatus as defined in claim 1, wherein the apparatus further comprises means for treating the surface of the boards in order to remove particles and static charge from the board surface.

11. The apparatus as defined in claim 1, wherein the apparatus further comprises means for controlling the means for applying ink to apply the ink patterns on the boards traveling within the predetermined space.

12. The apparatus as defined in claim 1, wherein the ink patterns are formed from an ink, the ink comprising a colorant and an alkyl ester solvent.

* * * * *